US012127617B2

(12) United States Patent
Dewey et al.

(10) Patent No.: US 12,127,617 B2
(45) Date of Patent: Oct. 29, 2024

(54) EYELASH EXTENSION SYSTEM AND METHODS

(71) Applicant: LASH OPCO, LLC, Southlake, TX (US)

(72) Inventors: Michael Dewey, Frisco, TX (US); Mabel Lee, Toronto (CA)

(73) Assignee: LASH OPCO, LLC, Southlake, TX (US)

( * ) Notice: Subject to any disclaimer, the term of this patent is extended or adjusted under 35 U.S.C. 154(b) by 0 days.

(21) Appl. No.: 18/067,082

(22) Filed: Dec. 16, 2022

(65) Prior Publication Data

US 2023/0189912 A1 Jun. 22, 2023

Related U.S. Application Data

(60) Provisional application No. 63/265,524, filed on Dec. 16, 2021.

(51) Int. Cl.
*A41G 5/02* (2006.01)

(52) U.S. Cl.
CPC ..... *A41G 5/02* (2013.01)

(58) Field of Classification Search
CPC ..... A41G 5/02
See application file for complete search history.

(56) References Cited

U.S. PATENT DOCUMENTS

| | | | | |
|---|---|---|---|---|
| 8,225,800 | B2 * | 7/2012 | Byrne | A41G 5/02 132/216 |
| 8,347,896 | B2 | 1/2013 | Liao | |
| 8,596,284 | B2 | 12/2013 | Byrne | |
| 8,657,170 | B2 | 2/2014 | Martinez | |
| 8,881,741 | B1 | 11/2014 | Mattson et al. | |
| 9,149,083 | B1 | 10/2015 | Dinh | |
| 9,185,943 | B2 | 11/2015 | Merszei | |
| 9,326,558 | B2 | 5/2016 | Martins et al. | |
| 9,486,025 | B1 | 11/2016 | Dinh | |
| 9,848,662 | B2 | 12/2017 | Dinh | |
| 9,913,506 | B2 | 3/2018 | Hansen et al. | |
| D850,715 | S | 6/2019 | Lotti | |
| 10,638,826 | B2 | 5/2020 | Lotti | |
| 10,660,388 | B2 | 5/2020 | Lotti | |

(Continued)

FOREIGN PATENT DOCUMENTS

| | | | |
|---|---|---|---|
| KR | 20150062395 | A | 6/2015 |
| WO | WO 2015/116247 | A1 | 8/2015 |
| WO | WO 2020/172746 | A1 | 9/2020 |

OTHER PUBLICATIONS

International Search Report and Written Opinion issued by the United States Patent and Trademark Office as International Searching Authority for PCT/US2022/081755, dated Mar. 30, 2023. (10 pgs.).

(Continued)

*Primary Examiner* — Rachel R Steitz
(74) *Attorney, Agent, or Firm* — Haynes and Boone, LLP; Michael J. Tobin; Alan N. Herda

(57) ABSTRACT

An eyelash extension includes an elongated base and a plurality of artificial lashes each attached to the elongated base. The plurality of artificial lashes is arranged in two or more clusters and each cluster includes two or more artificial lashes. The clusters are cinched together at a cinch point, which is spaced from the elongated base.

20 Claims, 7 Drawing Sheets

(56) References Cited

U.S. PATENT DOCUMENTS

| | | | |
|---|---|---|---|
| D890,430 | S | 7/2020 | Lotti |
| 10,716,349 | B2 | 7/2020 | Merszei |
| 10,721,984 | B2 | 7/2020 | Lotti |
| 10,813,874 | B2 | 10/2020 | Lee et al. |
| 10,888,133 | B2 | 1/2021 | Merszei |
| 11,219,260 | B2 | 1/2022 | Lotti |
| 11,234,472 | B2 | 2/2022 | Lotti |
| 11,253,020 | B2 | 2/2022 | Lotti |
| 11,330,855 | B2 | 5/2022 | Lotti |
| 11,330,856 | B2 | 5/2022 | Lotti |
| 2008/0196732 | A1 | 8/2008 | Merszei |
| 2009/0217938 | A1 | 9/2009 | Rabe et al. |
| 2010/0043816 | A1 | 2/2010 | Dix |
| 2015/0201692 | A1 | 7/2015 | Hansen et al. |
| 2016/0037848 | A1 | 2/2016 | Lee |
| 2016/0206031 | A1 | 7/2016 | Stoka |
| 2019/0183200 | A1 | 6/2019 | Song |
| 2019/0380413 | A1 | 12/2019 | Lotti |
| 2020/0196694 | A1 | 6/2020 | Lotti |
| 2020/0260839 | A1 | 8/2020 | Lotti |
| 2020/0275718 | A1 | 9/2020 | Sharafatdinova |
| 2020/0281295 | A1 | 9/2020 | Lotti |
| 2020/0323325 | A1 | 10/2020 | Kim et al. |
| 2020/0323329 | A1 | 10/2020 | Kim et al. |
| 2020/0390175 | A1 | 12/2020 | Lotti |
| 2020/0390176 | A1 | 12/2020 | Lotti |
| 2021/0093031 | A1* | 4/2021 | Mahoney ..... A41G 5/02 |
| 2021/0095170 | A1 | 4/2021 | Lotti |
| 2021/0100306 | A1* | 4/2021 | Lotti ..... A41G 5/02 |
| 2021/0161233 | A1 | 6/2021 | Lotti |
| 2021/0195976 | A1 | 7/2021 | Lotti |
| 2022/0105013 | A1 | 4/2022 | Nichols |

OTHER PUBLICATIONS

"iEnvy by Kiss Easy Grip Strip Lash Applicator Tweezer Black (KPA02)" (Kiss Store) Oct. 5, 2016 (Oct. 5, 2016) [online] retrieved from <URL: https://www.amazon.com/Envy-Kiss-Easy-Applicator-KPA02/dp/B01EPBRN6l/ref=cm_cr_arp_d_product_top?ie=UTF8>, entire document, especially Fig. on p. 1; review on p. 4. (7 pgs.).

"2 PCS Eyelash Applicator Tool Eyelash Tweezers for False Lashes 2 in 1 Curved Lash Tweezers with Comb Upgraded Dasign Lash Remover Clip Applicator Stainless Steel Nipper" (YiQiYi Store) Sep. 26, 2020 (Sep. 26, 2020) [online) retrieved from <URL: https://www.amazon.com/Eyelash-Applicator-Tweezers-Upgraded-Stainless/dp/B0B1N5RG3D/ref=cm_cr_arp_d_bdcrb_top?ie=UTF8>, entire document, especially Fig. on p. 1. (12 pgs.).

* cited by examiner

EYELASH EXTENSION SYSTEM AND METHODS

CROSS-REFERENCE TO RELATED APPLICATIONS

This application claims priority to U.S. Provisional Application No. 63/265,524 filed Dec. 16, 2021, the contents of which are herein incorporated in their entirety.

FIELD OF THE DISCLOSURE

The present disclosure relates to an eyelash extension system. More particularly, the disclosure relates to artificial eyelashes units for application to natural lashes and methods of applying and removing the same.

BACKGROUND

Artificial eyelashes may be used to alter the appearance of natural lashes, for example, by making the natural lashes appear longer or thicker. Artificial eyelashes may be applied professionally or at home (at-home lashes) and come in a variety of formats, including individual lashes and strip lashes. The artificial lashes can be applied in many distinct ways, such as by using threading, adhesives, or even magnets. These various forms of artificial eyelashes can last from a couple of days to several weeks. Conventionally, at-home lashes are less durable and will not withstand getting wet, such as during swimming, showering, exercising, and the like.

BRIEF DESCRIPTION OF THE DRAWINGS

Various embodiments of the present disclosure will be understood more fully from the detailed description given below and from the accompanying drawings. In the drawings, like reference numbers may indicate identical or functionally similar elements. Embodiments are described in detail hereinafter with reference to the accompanying figures, in which.

DETAILED DESCRIPTION

Figure 1:
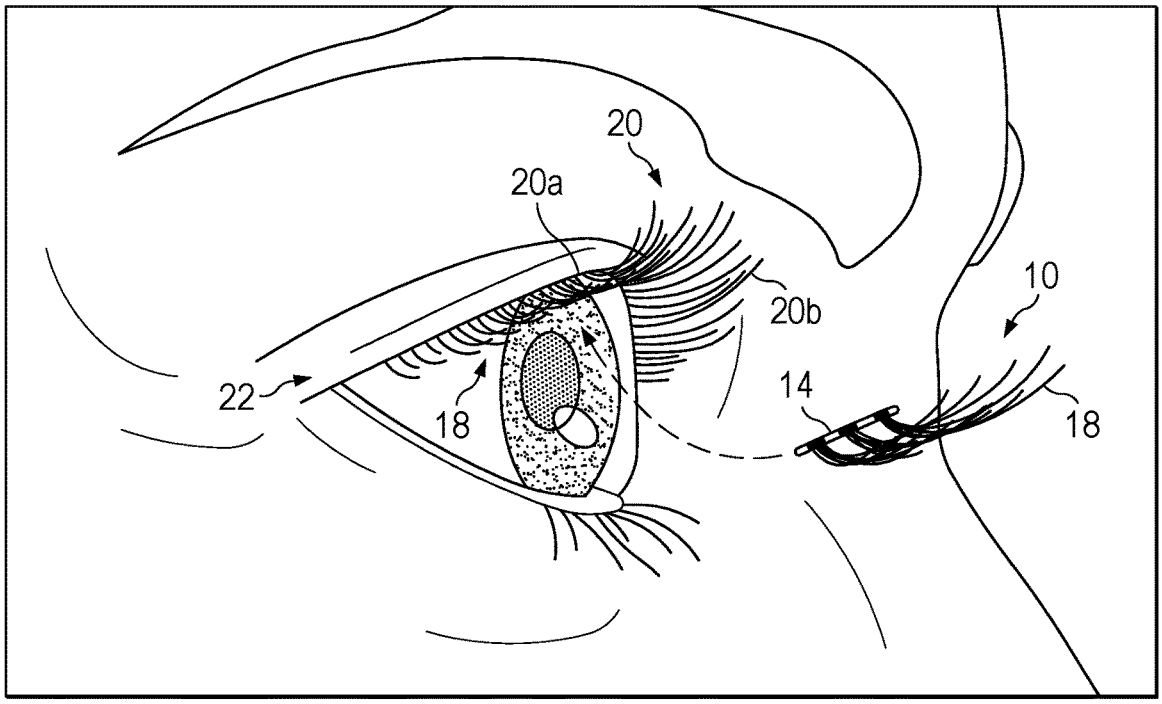
FIG. 1 is a perspective view of an artificial eyelash extension unit being applied to natural lashes according to an embodiment of the present disclosure.

The following disclosure provides many different embodiments or examples. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Referring to FIG. 1, an artificial eyelash extension unit 10 is configured to be applied to upper natural lashes 20. In some embodiments, the extension unit 10 is configured to be applied to an underside of the upper natural lashes 20. The application of the extension unit 10 includes applying an adhesive 18 to at least one of the extension unit 10 and the upper natural lashes 20. The adhesive 18 is water-proof or water-resistant once dried, that is the adhesive 18 is not water-soluble. The adhesive 18 is soluble in an oil-based solvent, such as an oil-based makeup remover or coconut oil. The adhesive 18 is configured to bond the extension unit 10 to the upper natural lashes 20 for at least 3 days, at least 5 days, at least 6 days, or at least 7 days of ordinary use. The adhesive 18 may be a polymer-based adhesive and may include (meth)acrylate polymers and/or copolymers.

Although FIG. 1 shows the extension unit 10 being applied to an underside of the natural lashes 20, the extension unit 10 may be alternatively or additionally applied to a top side of the natural lashes 20. In such an embodiment, the adhesive 18 may be applied to the underside of the extension unit 10 and the top side of the natural lashes 20 in a similar fashion as described above. In additional embodiments, the extension unit 10 may be applied to a top side or an underside of lower natural lashes in a similar manner as described herein for the upper natural lashes 20.

Figure 2:
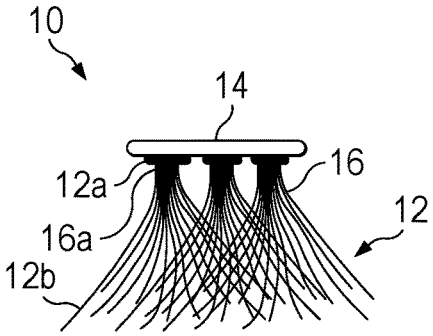
FIG. 2 is a bottom view of an artificial eyelash extension unit according to an embodiment of the present disclosure.

Turning to FIG. 2, a bottom view of the artificial eyelash extension unit 10 is shown. The extension unit 10 includes a plurality of artificial lashes 12 extending from an elongated base 14 such that a proximal end 12*a* of each lash 12 is secured to the base 14. The proximal ends 12*a* of the lashes may be secured to the base 14 using, for example, an adhesive. One or more extension units 10 may be applied to the natural lashes of a single eye, wherein an average width of natural lashes is about 28 mm to 30 mm. In some embodiments, the base 14 may have a length of about 2 mm to about 20 mm, about 3 mm to about 15 mm, about 4 mm to about 10 mm, about 5 mm to about 9 mm, or about 7 mm. In some embodiments, the extension units are sized such that 1 to 8, 2 to 6, or 3 to 4 extension units 10 are to be applied to each eye.

In some embodiments, the lashes 12 are grouped into one or more clusters 16, each cluster 16 including a plurality of lashes 12 bound together and being secured to the base 14. In some embodiments, each extension unit 10 includes at least two clusters 16 secured to the base 14. Two or more lashes of the plurality of lashes 12 within a single cluster 16 may be bound together by an adhesive or a fastener, such as lashing wrapped around the plurality of lashes 12, at a cinch point 16*a*. In some embodiments, the cinch points 16*a* do not include a heat fusion. In some embodiments, the extension unit 10 does not include any heat-fused lashes. That is, in such embodiments, none of the plurality of lashes 12 is bonded to the base 14 or any other artificial lash using heat fusion and the extension unit 10 does not include any junctures formed by heat fusion. In some embodiments, the cinch point 16*a* is spaced from the proximal end 12*a* of the lashes. In some embodiments, the cinch point 16*a* is also spaced from the base 14 such that the cinch point 16*a* does not contact the base 14. In some embodiments, the cinch point 16*a* is spaced at least 1 mm, at least 2 mm, or at least 3 mm from the base 14. In some embodiments, all of the plurality of lashes 12 within the cluster 16 are bound to one another at the cinch point 16*a*. In other embodiments, some of the plurality of lashes 12 may not be bound at the cinch point 16*a*.

In some embodiments, the clusters 16 are discrete between the base 14 and a distal end of the cinch points 16*a*. That is, the plurality of lashes 12 of any one cluster 16 do not cross, overlap, or intersect with the plurality of lashes 12 of any other cluster of the extension unit 10 from the base 14 to beyond the cinch point 16*a*. In such embodiments, the cinch points 16*a* are likewise discrete and are in a one-to-one relationship with their respective cluster 16. That is, the cinch points 16*a* do not cross, intersect, or overlap one another. In some embodiments, the clusters 16 are each independently and discretely cinched at the cinch points 16*a*, such that a number of cinch points 16*a* is equal to a number of clusters 16 and each cinch point 16*a* only cinches artificial lashes from a single cluster 16.

Figure 3:
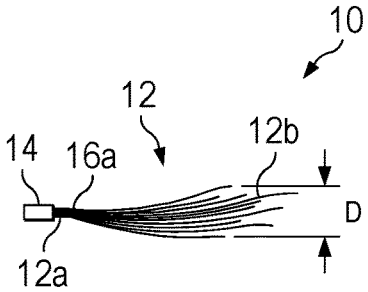
FIG. 3 is a side view of the artificial eyelash extension unit of FIG. 2.

Turning to FIG. 3, each of the lashes 12 extends from its proximal end 12*a* to a distal end 12*b*. A length from proximal end 12*a* to distal end 12*b* (shown in FIG. 4 as length $L_1$) may vary among the lashes 12 of the extension unit 10. In some embodiments, the lashes 12 of the extension unit 10 may have an average length of about 6 mm to about 18 mm, about 8 mm to about 16 mm, about 10 mm to about 14 mm, about 10 mm, about 12 mm, or about 14 mm. The lashes 12 may be straight or may have a generally curved profile wherein a degree a curvature may vary among the lashes 12 of the extension unit 10. In some embodiments, a depth D of the extension unit 10 may be at least about 6 mm, at least about 4 mm, or at least about 2 mm. The depth D is measured as a maximum transverse distance between two lash distal ends 12*b* when viewed in a projection onto a plane that is perpendicular to the elongated base 14 (for example, as shown in FIG. 3). In some embodiments, a ratio between the average length of the lashes 12 and the depth D is at most about 10, at most about 5, at most about 3, or at most about 2.

Figure 4:
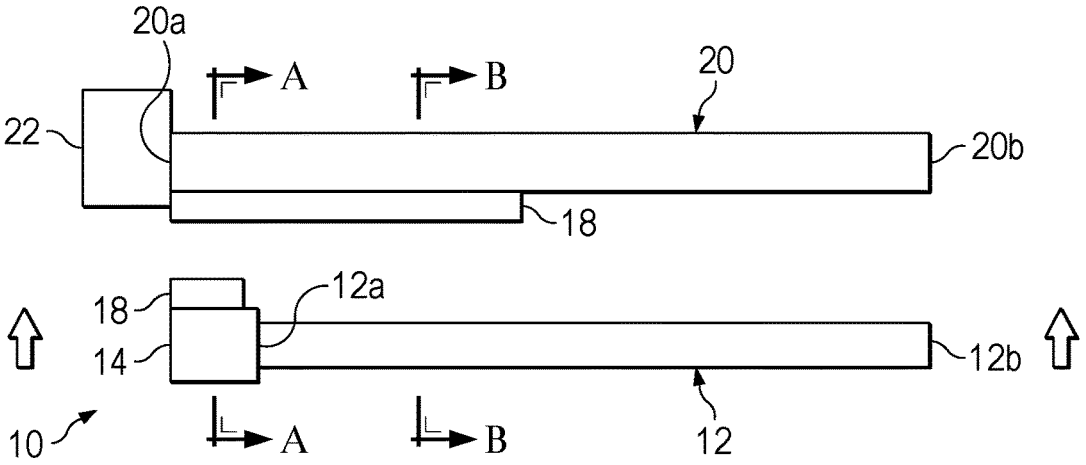
FIG. 4 is a diagrammatic side view of an artificial eyelash extension unit being applied to natural lashes according to an embodiment of the present disclosure.

Turning to FIG. 4, a diagrammatic view of an application process is shown. In particular, natural lashes 20 extend from the eyelid 22, from the root 20*a* to the distal end 20*b*. In the pictured embodiment, the adhesive 18 is applied to a portion of the natural lashes 20 from the root 20*a* to a mid-point of the natural lashes 20. Also shown are the artificial lashes 12 mounted to the base 14 at a proximal end 12*a* and extending to a distal end 12*b*. The adhesive 18 is applied to an entire upper surface of the base 14. In some embodiments, the adhesive 18 may be applied to a portion of the artificial lashes 12, e.g., as a result of the adhesive 18 running off of the base 14 onto the artificial lashes 12 or due to imprecise application by a user. As shown by the arrows, the artificial lashes 12 are positioned under the natural lashes 20 such that the adhesive 18 on the base 14 comes into contact with the natural lashes 20 and the adhesive 18 on the natural lashes 20, thereby adhering the artificial lash 12 (and the extension unit 10) to the natural lash 20.

As shown in FIG. 4, each artificial lash 12 has a length $L_1$, which as discussed above may vary among the plurality of artificial eyelashes 12 within the extension unit. Each of the natural lashes 20 has a length $L_2$, which varies along each set of eyelashes. In some embodiments, the average length of the artificial lashes 12 may be greater than an average length of the natural lashes 20. In other embodiments, the average length of the artificial lashes 12 may be less than the average length of the natural lashes 20. In yet other embodiments, the average length of the artificial lashes 12 may be equal to the average length of the natural lashes 20.

In some embodiments, the adhesive 18 is applied to both the upper natural lashes 20 and the extension unit 10. This configuration allows for a double bond that may provide better adhesion and more durability. In one or more embodiments, the adhesive 18 is be applied to the upper natural lashes 20 from a root 20*a* adjacent the eyelid 22 to about a mid-point of the upper natural lashes 20 between the root 20*a* and a distal end 20*b*. In some embodiments, the adhesive 18 is applied to 20-80%, 30-70%, 40-60%, or about 50% of the length $L_2$ of each of the upper natural lashes 20.

Figure 4A:
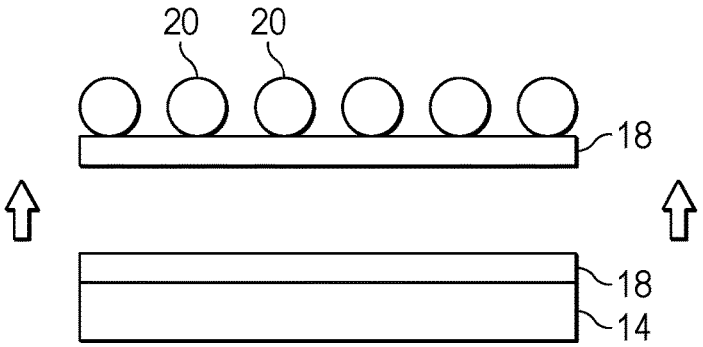
FIG. 4A is a diagrammatic cross section of the artificial eyelash extension unit of FIG. 4 along line A-A.
Figure 4B:
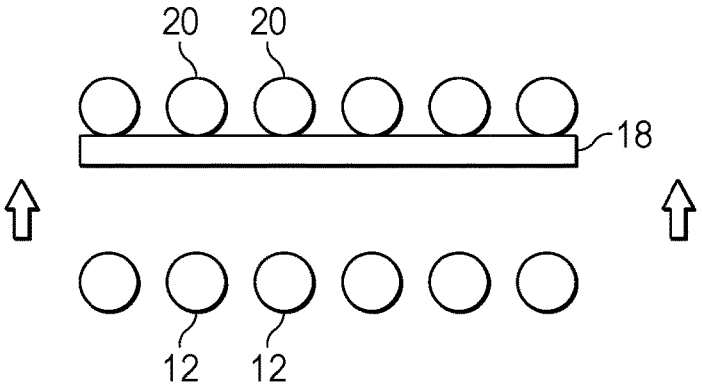
FIG. 4B is a diagrammatic cross section of the artificial eyelash extension unit of FIG. 4 along line B-B.

FIG. 4A is a cross-section of FIG. 4 along the line A-A at a position near the proximal end 12*a* and root 20*a*, where both the natural lashes 20 and the base 14 have the adhesive 18 applied to a surface thereof. Although the adhesive 18 is a shown as a solid layer in FIG. 4A, there may be spaces between the adhesive 18 across the natural lashes 20. As shown by the arrows in FIG. 4A, the adhesives 18 on the natural lashes 20 and the base 14 are to be brought into contact with one another. Turning to FIG. 4B, which is a diagrammatic cross section of FIG. 4 taken along the line B-B position between the proximal ends 12*a* and 20*a* and the distal ends 12*b* and 20*b*, the natural lashes 20 include the adhesive 18 at this position but the artificial lashes 12 do not include the adhesive 18. As indicated by the arrows, the adhesive 18 on the natural lashes 20 is to be brought into contact with the artificial lashes 12.

Figure 5:
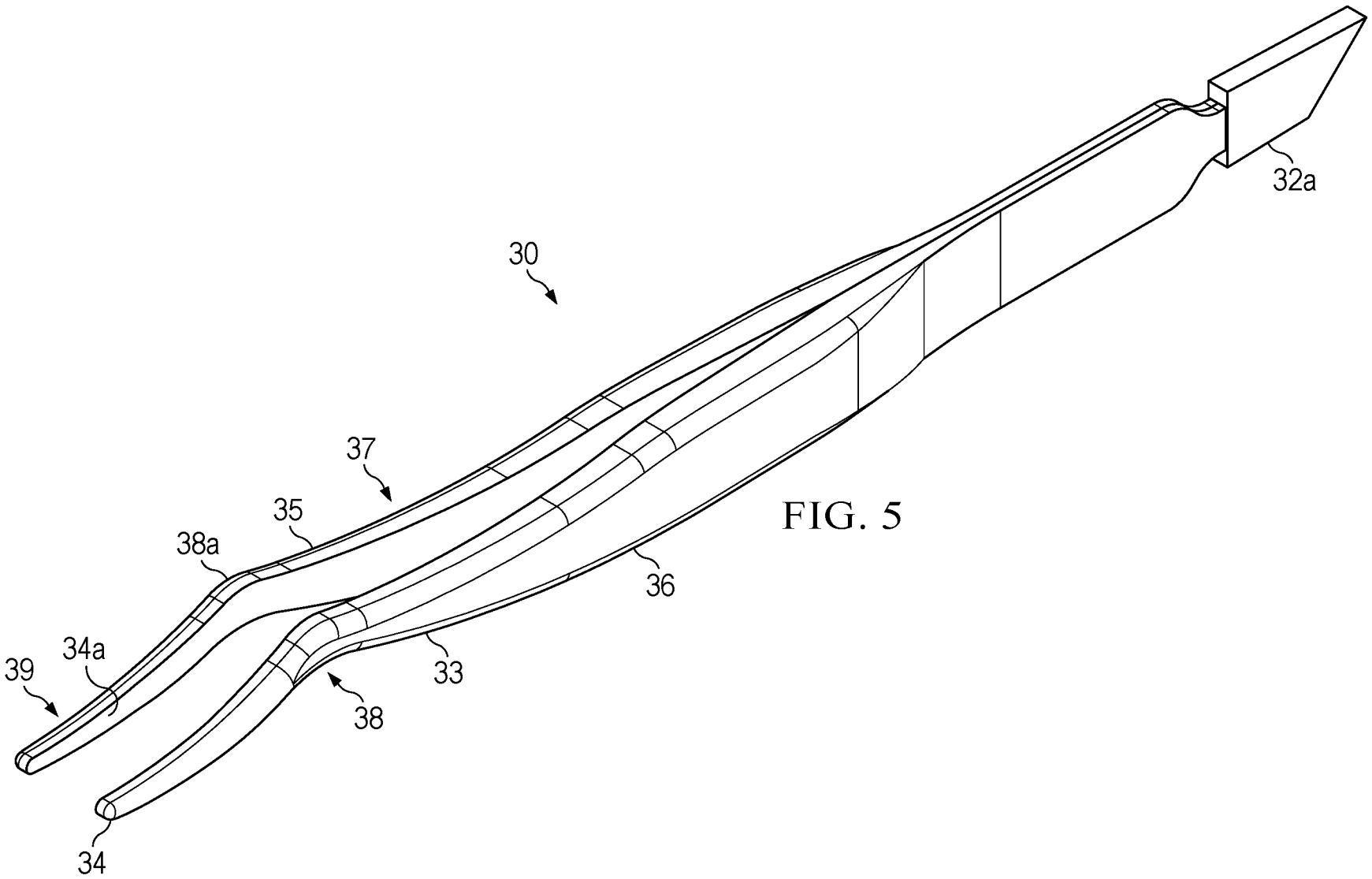
FIG. 5 is a perspective view of an applicator according to an embodiment of the present disclosure.

With reference to FIGS. 5-9, an applicator 30 for use with the extension units 10 of the present disclosure is shown. FIG. 5 is a perspective view of the applicator showing left arm 33 and right arm 35 joined at a foot 32 and outwardly biased from one another. Each of the left arm 33 and the right arm 35 terminate at a tip 34 opposite the foot 32. In some embodiments, the foot 32 includes a pusher 32*a* affixed thereto. The pusher 32*a* may formed of silicone or plastic. In the embodiments shown, the pusher 32*a* is angled and can be used to manipulate the extension unit 10 and aid in application of the extension unit 10 to the natural lashes 20.

The tips 34 are biased to be spaced from one another but application of force on the outer sides of the left arm 33 and the right arm 35 can cause the inner surfaces 34*a* proximate the tips 34 to contact one another. For example, force may be applied at the grip portion 36. In some embodiments, the grip portion 36 may include grooves or surface roughness or may be smooth. As shown in FIG. 5, between the grip portion 36 and the tips 34, the applicator 30 includes a bottom concave portion 38, that is, a concavity on the undersides of the left arm 33 and the right arm 35. Opposite the bottom concave portion 38, the applicator 30 includes a knuckle 38*a*. Between the knuckle 38*a* and the grip portion 36 and between the knuckle 38*a* and the tips 34, the applicator 30 includes a first top concave portion 37 and a second top concave portion 39, that is, two concavities on the tops of the left arm 33 and the right arm 35.

Figure 7:
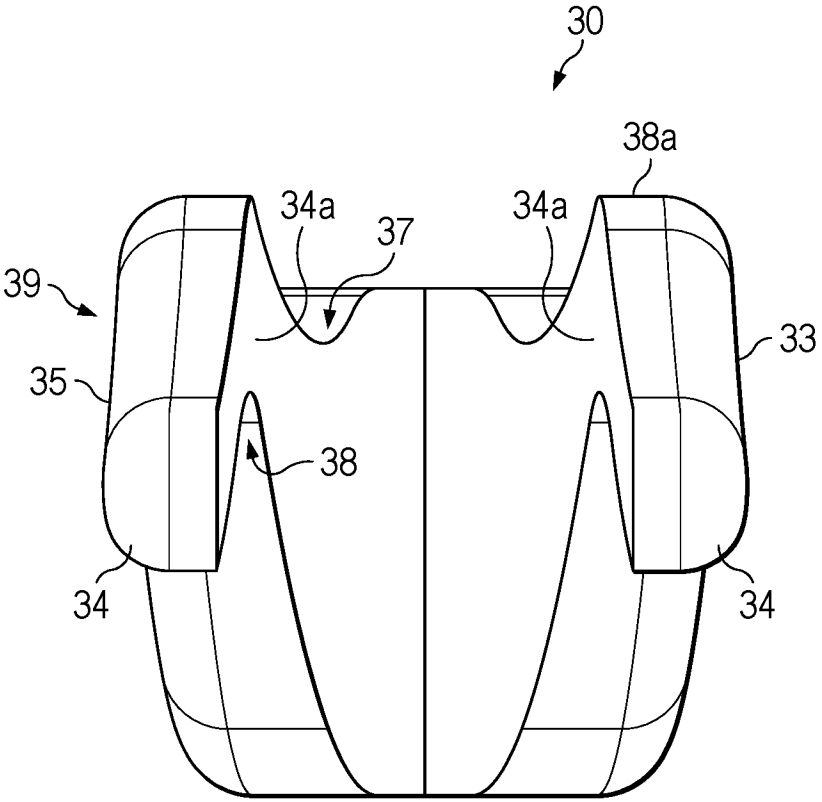
FIG. 7 is a rear view of the applicator of FIG. 5.
Figure 6:
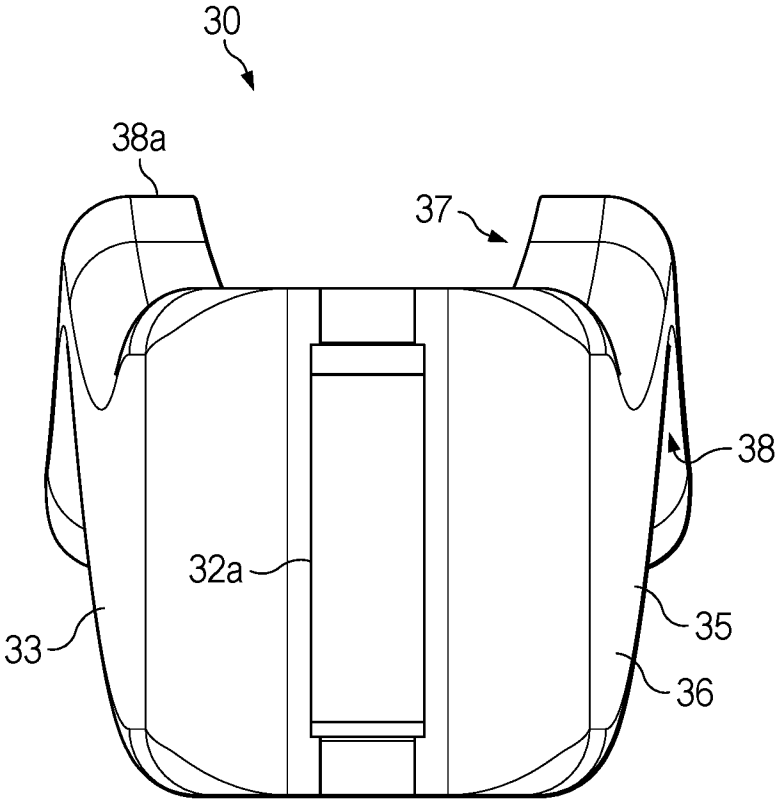
FIG. 6 is a front view of the applicator of FIG. 5.
Figure 8:
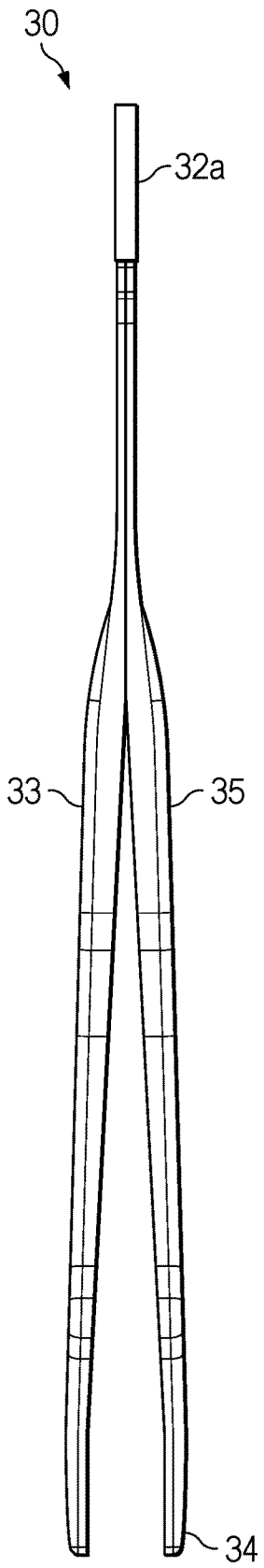
FIG. 8 is a bottom view of the applicator of FIG. 5.
Figure 9:
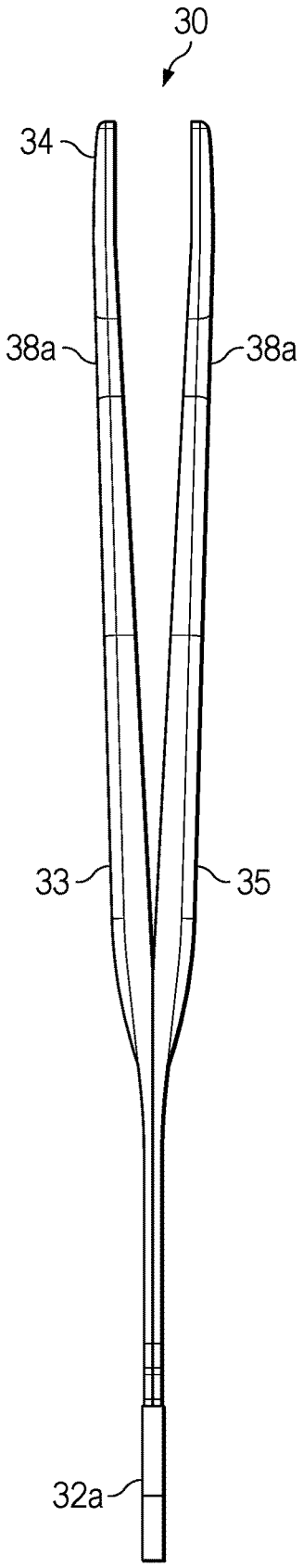
FIG. 9 is a top view of the applicator of FIG. 5.

FIG. 6 is a front view of the applicator 30. FIG. 7 is a rear view of the applicator 30. FIG. 8 is a bottom view of the applicator 30 and FIG. 9 is a top view of the applicator 30. As shown in FIGS. 5-9, a portion of the applicator 30 between the grip portion 36 and the foot 32 is generally straight. In some embodiments, the tips 34 may be rounded, for example, having a semicircular profile. In some embodiments, the tips 34 may be squared off and have a flat edge. In some embodiments, a side thickness of the left arm 33 and the right arm 35 may uniformly decrease from the grip portion 36 to the tips 34.

Figure 10:
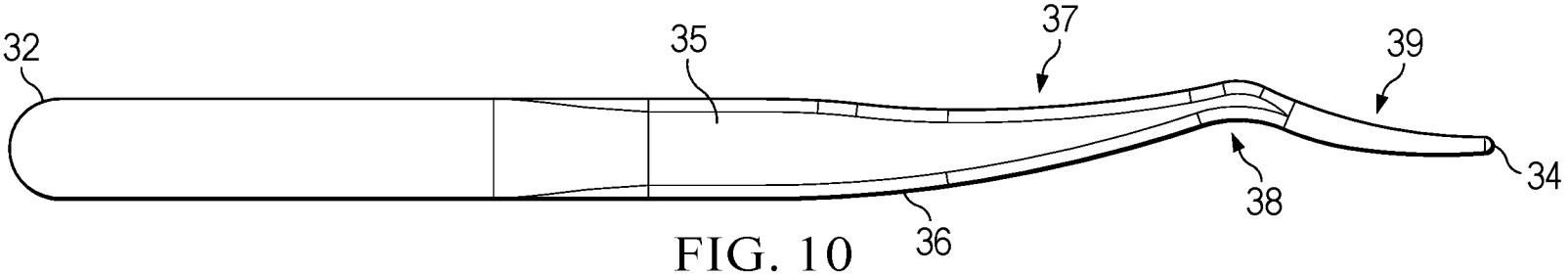
FIG. 10 is a side view of an applicator according to an embodiment of the present disclosure.
Figure 11:
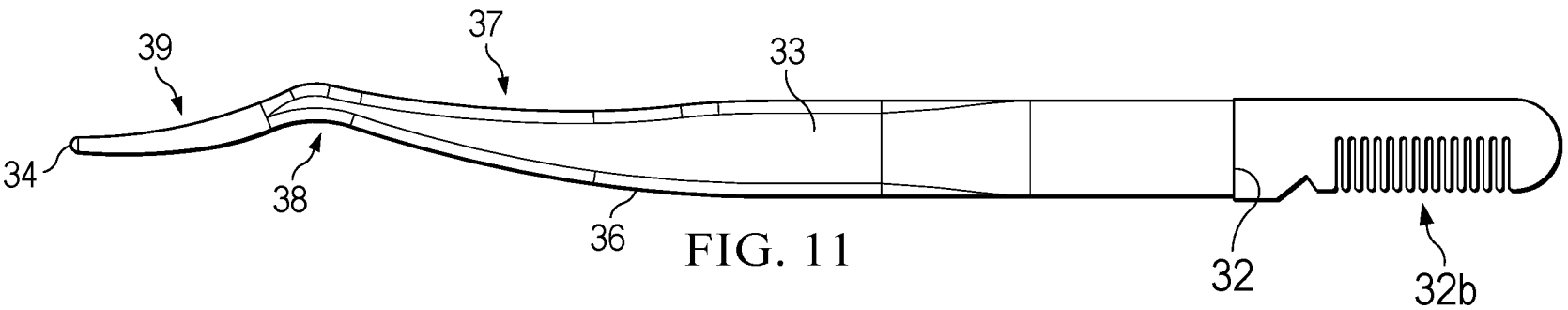
FIG. 11 a side view of an applicator according to an embodiment of the present disclosure.

With reference to FIG. 10 and FIG. 11, the foot 32 of the applicator 30 may or may not include a tool. For instance, as shown in FIG. 10, the foot 32 does not include a tool. In another embodiment shown in FIG. 11, the foot 32 may include a comb 32*b*, which can be used for combing eyelashes 20 and/or eyebrows.

Figure 12:
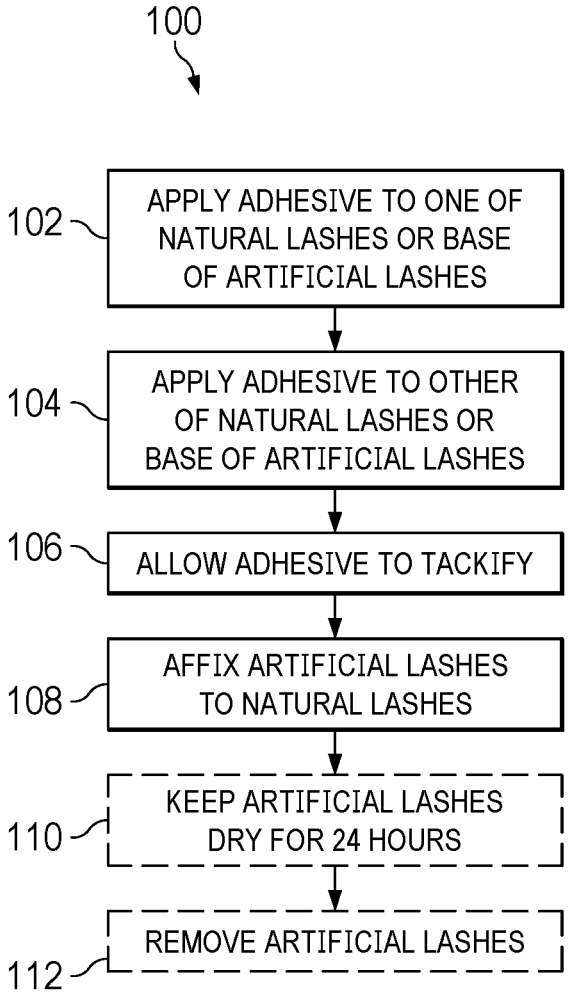
FIG. 12 is a flow diagram of a method for applying an artificial lash extension unit to natural lashes according to an embodiment of the present disclosure.

Turning to FIG. 12, a method 100 of applying the extension unit 10 to upper natural lashes 20 is shown. In a step 102, the adhesive 18 is applied to one of the extension unit 10, namely the base 14, or the upper natural lashes 20. The adhesive coverage may be as described above. In a step 104, the adhesive 18 is applied to the other of the extension unit 10 or the upper natural lashes 20. Again, the adhesive coverage may be as described above. The adhesive 18 used for the extension unit 10 and the upper natural lashes 20 may be the same or different. In some embodiments, the extension unit 10 is applied to an underside of the upper natural lashes 20. In such embodiments, steps 102 and 104 include applying the adhesive to a top side of the base 14 of the extension unit 10 and to an underside of the upper natural lashes 20. In some embodiments, step 102 and/or step 104 may include using a spoolie brush to apply the adhesive 18. In such embodiments, the adhesive 18 may be provided in a bottle into which the spoolie brush can be inserted. In other embodiments, excess adhesive 18 may be applied to the extension unit 10 by dipping or brushing and then the excess adhesive 18 may be transferred from the extension unit 10 onto the upper natural lashes 20 such that both the extension unit 10 and the upper natural lashes 20 have adhesive 18 thereon.

In a step 106, the adhesive is allowed to tackify for a set period of time. This time may be measured either from the end of step 102 or from the end of step 104. The set period of time may be at least 5 seconds, at least 10 second, at least 15 second, at least 20 seconds, or 10 to 15 seconds. In some embodiments, the set period of time is no more than 60 seconds, no more than 45 second, or no more than 30 seconds such that the adhesive 18 remains tacky and does not dry. In some embodiments, step 106 may include fanning the extension unit 10 having the adhesive 18 thereon and/or blowing on the extension unit 10. In some embodiments, step 106 may include fanning the natural lashes 20 having the adhesive 18 thereon.

Next, in a step 108, the extension unit 10 is applied to the upper natural lashes 20. Step 108 may be facilitated by using the applicator 30 to grasp the extension unit 10 and position the extension unit 10 on the upper natural lashes 20. The applicator 30 may also be used to clamp around both the extension unit 10 and the upper natural lashes 20 to apply pressure and ensure tight adhesion.

In one or more embodiments, a plurality of artificial eyelash extension units 10 are applied to the upper natural lashes 20. In such embodiments, steps 102 through 108 may be repeated for each extension unit 10. In some of these embodiments, step 102 or step 104 may include applying the adhesive 18 to two or more extension units 10 of the plurality of extension units 10. Each of the extension units 10 of the plurality of extension units 10 may be the same or different. In some embodiments, the extension units 10 of the plurality of extension units 10 differ from one another in average length of the lashes 12 and/or in depth of the respective extension units 10. In some embodiments, two extension units 10 of the plurality of extension units 10 have the same ratio of average lash length to depth but differ in terms of average lash length. When a plurality of extension units 10 are applied, step 108 may include arranging the extension units 10 along the upper natural lashes 20 such that adjacent extension units 10 are spaced from one another, about one another, overlap one another, or a combination thereof.

In some embodiments, the method 100 may include a step 110 of keeping the natural lashes 20 and artificial lashes 12 dry for a period of time, such as at least 24 hours. Step 110 allows the adhesive 18 to cure and may improve the strength of the bond between the natural lashes 20 and the extension unit 10.

In some embodiments, the method 100 may include a step 112 of removing the extension unit 10. Step 112 may include using an oil-based solvent to at least partially dissolve the adhesive 18 and thereby allow the extension unit 10 to be separated from the upper natural lashes 20. In some embodiments, the oil-based solvent is an oil-based makeup remover or coconut oil. In some embodiments, step 112 comprises soaking the upper natural lashes 20 and the extension unit 10 in the oil-based solvent for at least 15 seconds, at least 30 seconds, or at least 60 seconds.

In an embodiment, step 102 comprises applying the adhesive 18 from the root 20*a* of the natural lashes 20 to a midpoint of a portion of the natural lashes 20 at an outer corner of the eye; step 104 comprises applying the adhesive 18 to the artificial lashes 12 of a first extension unit 10; step 106 comprises waiting 10 to 15 second to allow the adhesive 18 to tackify; and step 108 comprises using the applicator 30 to clamp the extension unit 10 to the portion of natural lashes 20. In this embodiment, steps 102 through 108 may be repeated working inward from the outer corner of the eye to an inner corner of the eye until a desired look it achieved.

A method has been described herein. The method includes providing the artificial eyelash extension unit having an elongated base having a plurality of artificial eyelashes attached thereto and extending therefrom, applying a first adhesive to the base, applying a second adhesive to the natural lashes, wherein the second adhesive may be the same or different from the first adhesive, waiting for a period of time of at least 5 seconds or about 10 to 15 seconds to allow the adhesive to tackify, and attaching the artificial eyelash extension unit to the natural lashes such that the first and second adhesives contact one another. The first adhesive and the second adhesive may be the same and may include a polymer-based adhesive. The polymer-based adhesive may be not water-soluble. The polymer-based adhesive may be soluble in an oil-based solvent. Applying the second adhesive may include application of the second adhesive to no more than 60% of a length of the natural lashes. Applying the second adhesive may include applying the second adhesive from roots of the natural lashes to a position between the roots and distal ends of the natural lashes. The artificial eyelash extension unit may be applied to an underside of the natural lashes, such that the first adhesive is applied to a top surface of the base and the second adhesive is applied to an underside of the natural lashes. Applying the first adhesive may be completed before applying the second adhesive and the period of time may be at least 10 seconds measured from after applying the second adhesive. Applying the second adhesive may be completed before applying the first adhesive and the period of time may be at least 10 seconds measured from after applying the first adhesive.

An applicator had been described herein. The applicator includes a first arm; a second arm connected to the first arm at a base; wherein the first and second arms comprise tips opposite the base; wherein the tips are biased away from one another; a grip portion between the base and the tips; a bottom concave portion on an underside of the first and second arms and positioned between the grip portion and the tips; knuckles formed on top sides of the first and second arms opposite the bottom concave portion; a first top concave portion formed on top sides of the first and second arms between the grip portion and the knuckles; and a second top concave portion formed on top sides of the first and second arms between the knuckles and the tips. The applicator may include a tool affixed to the base, the tool may be an angled silicone pusher or a comb.

An artificial eyelash extension unit has been described herein. The artificial eyelash extension unit includes an elongated base; and a plurality of artificial lashes each having a proximal end and a distal end. A proximal end of each lash is attached to the elongated base, the plurality of artificial lashes is arranged in two or more clusters, each cluster comprising two or more artificial lashes, the clusters are cinched together at a cinch point, and the cinch point is spaced from the elongated base. The cinch point may be spaced from the base by at least 2 mm. The cinch point may include an adhesive or lashing bonding the two or more artificial lashes to one another. The artificial lashes may have lengths measured from the proximal end to the distal end, the eyelash extension may have a depth measured as a maximum transverse distance between two lash distal ends when the eyelash extension is viewed in a projection onto a plane perpendicular to the elongated base, and a ratio of an average length of the artificial lashes to the depth may be at most 3. The depth may be at least 5 mm.

A system has been described herein. The system includes a plurality of eyelash extensions each comprising an elongated base; and a plurality of artificial lashes each having a proximal end and a distal end, wherein a proximal end of each lash is attached to the elongated base; a polymer-based adhesive configured to bind the plurality of eyelash extension to natural lashes, wherein the adhesive is water insoluble; an applicator configured to grip the eyelash extensions and position the eyelash extensions on the natural lashes; and an oil-based remover, wherein the polymer-based adhesive is soluble in the oil-based remover.

It is understood that variations may be made in the foregoing without departing from the scope of the disclosure.

In one or more embodiments, the elements and teachings of the various disclosed embodiments may be combined in whole or in part in some or all of the disclosed embodiments. In addition, one or more of the elements and teachings of the various disclosed embodiments may be omitted, at least in part, or combined, at least in part, with one or more of the other elements and teachings of the various disclosed embodiments.

Any spatial references such as, for example, "upper," "lower," "above," "below," "between," "bottom," "vertical," "horizontal," "angular," "upwards," "downwards," "side-to-side," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

In one or more embodiments, while different steps, processes, and procedures are described as appearing as distinct acts, one or more of the steps, one or more of the processes, or one or more of the procedures may also be performed in different orders, simultaneously or sequentially. In one or more embodiments, the steps, processes, or procedures may be merged into one or more steps, processes, or procedures. In one or more embodiments, one or more of the operational steps in each embodiment may be omitted. Moreover, in some instances, some features of the present disclosure may be employed without a corresponding use of the other features.

Although several embodiments have been disclosed in detail above, the embodiments disclosed are not limiting, and those skilled in the art will readily appreciate that many other modifications, changes, and substitutions are possible in the disclosed embodiments without materially departing from the novel teachings and advantages of the present disclosure. Accordingly, all such modifications, changes, and substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112(f) for any limitations of any of the claims herein, except for those in which the claim expressly uses the word "means" together with an associated function.

What is claimed is:

1. An eyelash extension comprising:

an elongated base; and a plurality of artificial lashes each having a proximal end and a distal end, wherein a proximal end of each artificial lash is attached to the elongated base;

wherein the plurality of artificial lashes is arranged in three or more clusters, each cluster comprising two or more artificial lashes;

wherein the three or more clusters are each individually and discretely cinched together at cinch points; and wherein the three or more clusters comprise:

a first cluster of two or more artificial lashes cinched together at a first cinch point, wherein the two or more artificial lashes of the first cluster are bound together at the first cinch point, which bounding is different from the attachment of the respective proximal ends of the two or more artificial lashes of the first cluster to the elongated base;

wherein the two or more artificial lashes of the first cluster do not cross, overlap, or intersect with the two or more artificial lashes of any other cluster from the elongated base to the first cinch point in a first direction;

wherein the first direction lies in a plane in which the elongated base extends lengthwise in a second direction;

wherein the first direction is perpendicular to the second direction in which the elongated base extends lengthwise in the plane;

wherein the two or more artificial lashes of the first cluster do not cross, overlap, or intersect with the two or more artificial lashes of any other cluster between, in the first direction, the first cinch point and a first position beyond the first cinch point;

wherein the first cinch point is positioned, in the first direction, between:

the respective proximal ends of the two or more artificial lashes of the first cluster; and the respective distal ends of the two or more artificial lashes of the first cluster;

wherein the first cinch point is positioned, in the first direction, between the elongated base and the respective distal ends of the two or more artificial lashes of the first cluster;

wherein the first cinch point is positioned, in the first direction, between the elongated base and the first position beyond the first cinch point; and wherein the first position beyond the first cinch point is between, in the first direction:

the respective proximal ends of the two or more artificial lashes of the first cluster; and the respective distal ends of the two or more artificial lashes of the first cluster;

wherein the first position beyond the first cinch point is between, in the first direction, the elongated base and the respective distal ends of the two or more artificial lashes of the first cluster; and wherein the first position beyond the first cinch point is between, in the first direction, the first cinch point and the respective distal ends of the two or more artificial lashes of the first cluster;

a second cluster of artificial lashes cinched together at a second cinch point, wherein the two or more artificial lashes of the second cluster are bound together at the second cinch point, which bounding is different from the attachment of the respective proximal ends of the two or more artificial lashes of the second cluster to the elongated base;

wherein the two or more artificial lashes of the second cluster do not cross, overlap, or intersect with the two or more artificial lashes of any other cluster from the elongated base to the second cinch point in the first direction;

wherein the two or more artificial lashes of the second cluster do not cross, overlap, or intersect with the two or more artificial lashes of any other cluster between, in the first direction, the second cinch point and a second position beyond the second cinch point;

wherein the second cinch point is positioned, in the first direction, between:

the respective proximal ends of the two or more artificial lashes of the second cluster; and the respective distal ends of the two or more artificial lashes of the second cluster;

wherein the second cinch point is positioned, in the first direction, between the elongated base and the respective distal ends of the two or more artificial lashes of the second cluster;

wherein the second cinch point is positioned, in the first direction, between the elongated base and the second position beyond the second cinch point; and wherein the second position beyond the second cinch point is between, in the first direction:

the respective proximal ends of the two or more artificial lashes of the second cluster; and the respective distal ends of the two or more artificial lashes of the second cluster;

wherein the second position beyond the second cinch point is between, in the first direction, the elongated base and the respective distal ends of the two or more artificial lashes of the second cluster;

wherein the second position beyond the second cinch point is between, in the first direction, the second cinch point and the respective distal ends of the two or more artificial lashes of the second cluster;

wherein at least one of the two or more artificial lashes of the second cluster crosses, overlaps, or intersects with at least one of the two or more artificial lashes of the first cluster at a third position beyond the second position in the first direction;

wherein the third position beyond the second position is between, in the first direction:

the respective proximal ends of the two or more artificial lashes of the second cluster; and the respective distal ends of the two or more artificial lashes of the second cluster;

wherein the third position beyond the second position is between, in the first direction, the elongated base and the respective distal ends of the two or more artificial lashes of the second cluster;

wherein the third position beyond the second position is between, in the first direction, the second cinch point and the respective distal ends of the two or more artificial lashes of the second cluster;

wherein the third position beyond the second position is between, in the first direction, the second position and the respective distal ends of the two or more artificial lashes of the second cluster;

wherein the respective proximal ends of the two or more artificial lashes of the second cluster are attached to the elongated base so that:

a first spacing is defined, in the second direction, along the elongated base, and between:

all the respective proximal ends of the two or more artificial lashes of the first cluster, and all the respective proximal ends of the two or more artificial lashes of the second cluster;

the elongated base is devoid of any artificial lashes within the first spacing along the elongated base;

wherein a second spacing is defined, in a third direction, between the first cinch point and the second cinch point;

wherein the third direction lies in the plane in which the elongated base extends lengthwise in the second direction;

wherein the third direction is parallel to the second direction in which the elongated base extends lengthwise in the plane; and wherein the second spacing is not less than the first spacing and thus the first spacing is not greater than the second spacing; and a third cluster of artificial lashes cinched together at a third cinch point, wherein the two or more artificial lashes of the third cluster are bound together at the third cinch point, which bounding is different from the attachment of the respective proximal ends of the two or more artificial lashes of the third cluster to the elongated base;

wherein the two or more artificial lashes of the third cluster do not cross, overlap, or intersect with the two or more artificial lashes of any other cluster from the elongated base to the third cinch point in the first direction;

wherein the two or more artificial lashes of the third cluster do not cross, overlap, or intersect with the two or more artificial lashes of any other cluster between, in the first direction, the third cinch point and a fourth position beyond the third cinch point;

wherein the third cinch point is positioned, in the first direction, between:

the respective proximal ends of the two or more artificial lashes of the third cluster; and the respective distal ends of the two or more artificial lashes of the third cluster;

wherein the third cinch point is positioned, in the first direction, between the elongated base and the respective distal ends of the two or more artificial lashes of the third cluster;

wherein the third cinch point is positioned, in the first direction, between the elongated base and the fourth position beyond the third cinch point;

wherein the fourth position beyond the third cinch point is between, in the first direction:

the respective proximal ends of the two or more artificial lashes of the third cluster; and the respective distal ends of the two or more artificial lashes of the third cluster;

wherein the fourth position beyond the third cinch point is between, in the first direction, the elongated base and the respective distal ends of the two or more artificial lashes of the third cluster;

wherein the fourth position beyond the third cinch point is between, in the first direction, the third cinch point and the respective distal ends of the two or more artificial lashes of the third cluster;

wherein at least one of the two or more artificial lashes of the third cluster crosses, overlaps, or intersects with at least one of the two or more artificial lashes of the second cluster at a fifth position beyond the fourth position in the first direction; and wherein the fifth position beyond the fourth position is between, in the first direction:

the respective proximal ends of the two or more artificial lashes of the third cluster; and the respective distal ends of the two or more artificial lashes of the third cluster;

wherein the fifth position beyond the fourth position is between, in the first direction, the elongated base and the respective distal ends of the two or more artificial lashes of the third cluster;

wherein the fifth position beyond the fourth position is between, in the first direction, the third cinch point and the respective distal ends of the two or more artificial lashes of the third cluster;

wherein the fifth position beyond the fourth position is between, in the first direction, the fourth position and the respective distal ends of the two or more artificial lashes of the third cluster;

wherein the respective proximal ends of the two or more artificial lashes of the third cluster are attached to the elongated base so that:

a third spacing is defined, in the second direction, along the elongated base, and between:

all the respective proximal ends of the two or more artificial lashes of the second cluster, and all the respective proximal ends of the two or more artificial lashes of the third cluster; and the elongated base is devoid of any artificial lashes within the third spacing along the elongated base;

wherein a fourth spacing is defined, in a fourth direction, between the second cinch point and the third cinch point;

wherein the fourth direction lies in the plane in which the elongated base extends lengthwise in the second direction;

wherein the fourth direction is parallel to the second direction in which the elongated base extends lengthwise in the plane;

wherein the fourth spacing is not less than the third spacing and thus the third spacing is not greater than the fourth spacing;

wherein a fifth spacing is defined, in the second direction, along the elongated base, and between:

all the respective proximal ends of the two or more artificial lashes of the first cluster, and all the respective proximal ends of the two or more artificial lashes of the third cluster;

wherein the fifth spacing is greater than each of the first and third spacings;

wherein a sixth spacing is defined, in a fifth direction, between the first cinch point and the third cinch point;

wherein the fifth direction lies in the plane in which the elongated base extends lengthwise in the second direction;

wherein the fifth direction is parallel to the second direction in which the elongated base extends lengthwise in the plane; and wherein the sixth spacing is greater than each of the second and fourth spacings.

2. The eyelash extension of claim 1, wherein the cinch points each comprise an adhesive bonding the two or more artificial lashes to one another.

3. The eyelash extension of claim 1, wherein the cinch points each comprise lashing bonding the two or more artificial lashes to one another and wherein the proximal end of each lash is attached to the elongated base with an adhesive.

4. The eyelash extension of claim 1, wherein the eyelash extension comprises a depth measured as a maximum transverse distance between two lash distal ends when the eyelash extension is viewed in a projection onto a plane perpendicular to the elongated base, and wherein a ratio of an average length of the artificial lashes to the depth is at most 3.

5. The eyelash extension of claim 4, wherein the depth is at least 5 mm.

6. The eyelash extension of claim 1, wherein the cinch points are spaced from the elongated base and the proximal ends of each artificial lash; and wherein the cinch points are each at least 2 mm from the elongated base.

7. The eyelash extension of claim 1, wherein a number of cinch points is equal to a number of clusters and each cinch point cinches together artificial lashes only from a single cluster.

8. The eyelash extension of claim 7, wherein the eyelash extension does not comprise any heat fused junctures.

9. A method of applying the eyelash extension of claim 1 to natural lashes, the method comprising:

providing the eyelash extension;

applying a first adhesive to the elongated base of the eyelash extension;

applying a second adhesive to the natural lashes, wherein the second adhesive as the same composition as that of the first adhesive or has a different composition than that of the first adhesive;

waiting for a period of time of at least 5 seconds to allow the first and second adhesives to tackify; and attaching the eyelash extension to the natural lashes such that the first and second adhesives contact one another.

10. The method of claim 9, wherein the first adhesive and the second adhesive each comprise a polymer-based adhesive.

11. The method of claim 10, wherein the polymer-based adhesive is not water-soluble.

12. The method of claim 11, wherein the polymer-based adhesive is soluble in an oil-based solvent.

13. The method of claim 9, wherein applying the second adhesive comprises application of the second adhesive to no more than 60% of a length of each of the natural lashes.

14. The method of claim 13, wherein applying the second adhesive comprises applying the second adhesive from roots of the natural lashes to a position between the roots and distal ends of the natural lashes.

15. The method of claim 9, wherein the eyelash extension unit is applied to an underside of the natural lashes, wherein the first adhesive is applied to a top surface of the elongated base, and wherein the second adhesive is applied to the underside of the natural lashes.

16. The method of claim 9, wherein applying the first adhesive is completed before applying the second adhesive.

17. The method of claim 16, wherein the period of time is about 9 to 14 seconds measured from after applying the second adhesive.

18. The method of claim 9, wherein applying the second adhesive is completed before applying the first adhesive.

19. The method of claim 18, wherein the period of time is about 10 to 15 seconds measured from after applying the first adhesive.

20. An eyelash extension system, the system comprising:

a plurality of the eyelash extensions of claim 1;

a polymer-based adhesive configured to bind the plurality of eyelash extensions to natural lashes, wherein the adhesive is water insoluble;

an applicator configured to grip the eyelash extensions and position the eyelash extensions on the natural lashes; and an oil-based remover, wherein the polymer-based adhesive is soluble in the oil-based remover.

* * * * *